United States Patent [19]

Van Dame

[11] Patent Number: 4,833,838

[45] Date of Patent: May 30, 1989

[54] ENERGY-EFFICIENT SKYLIGHT STRUCTURE

[76] Inventor: James Van Dame, 420 Rupard St., Lake Elsinore, Calif. 92330

[21] Appl. No.: 137,233

[22] Filed: Dec. 22, 1987

Related U.S. Application Data

[63] Continuation-in-part of Ser. No. 677,825, Dec. 4, 1984, Pat. No. 4,733,505.

[51] Int. Cl.[4] ..... E04B 7/00

[52] U.S. Cl. ..... 52/22; 52/200; 52/39

[58] Field of Search ..... 52/22, 200, 208, 72, 52/28, 29, 39, 488, 308

[56] References Cited

U.S. PATENT DOCUMENTS

| | | | |
|---|---|---|---|
| 4,339,900 | 7/1982 | Freeman | 52/200 X |
| 4,468,899 | 9/1984 | Miller | 52/200 X |
| 4,726,156 | 2/1988 | Cousino | 52/200 X |
| 4,733,505 | 3/1988 | Van Dame | 52/22 |

FOREIGN PATENT DOCUMENTS

| | | | |
|---|---|---|---|
| 2386970 | 12/1978 | France | 52/200 |

OTHER PUBLICATIONS

*Skylighting with Ventarama,* 1985 Sweets' Catalog File, 7.8.

*Primary Examiner*—Carl D. Friedman
*Attorney, Agent, or Firm*—Price, Gess & Ubell

[57] ABSTRACT

A skylight structure that is sealed at the room ceiling rather than at the roof membrane is provided. The structure includes a sealed light-diffusing panel attached to the ceiling, a light tube to channel light from the roof membrane to the light-diffusing panel, and a curbless roof membrane structure. The light tube is constructed on-site using lengths of light-reflective material and special fastening means that provide great versatility in negotiating obstructions encountered in the space between the roof and ceiling.

13 Claims, 8 Drawing Sheets

FIG. 21
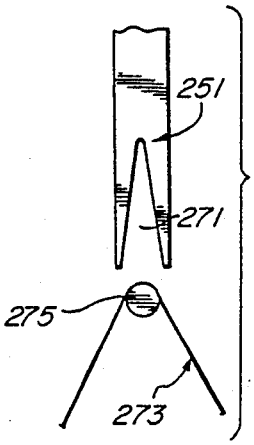
FIG. 22
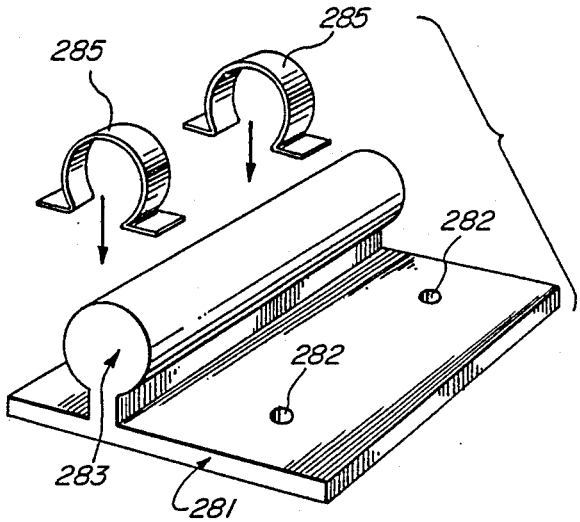
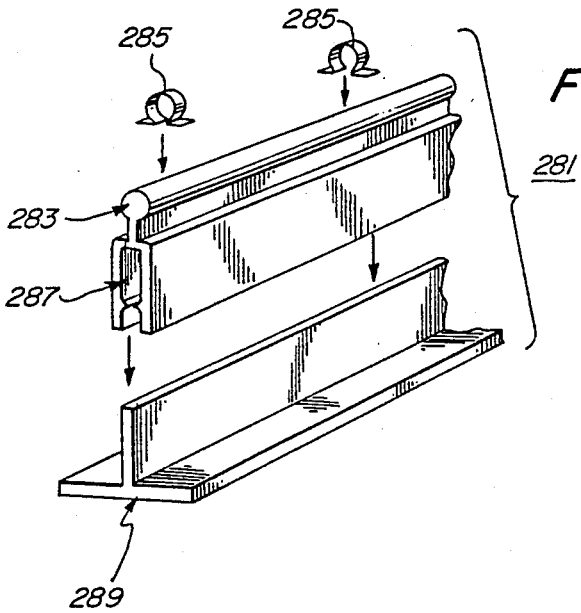
FIG. 23

ENERGY-EFFICIENT SKYLIGHT STRUCTURE

This application is a continuation-in-part of application Ser. No. 677,825 filed Dec. 4, 1984 for Energy Efficient Skylight Structure now U.S. Pat. No. 4,733,505.

BACKGROUND OF THE INVENTION

1. Field of the Invention

The present invention relates generally to improvements in skylight structures and more particularly pertains to a new and improved roof membrane structure, light tunnel and ceiling fixture which illuminates a room by way of natural light and artificial light from means mounted therein, when desired.

2. Description of the Prior Art

There are considerable prior art structures relating to ceiling-mounted light fixtures which cover an entire ceiling, sometimes also called "dropped ceiling," or simply are fixtures that are mounted to a ceiling. Examples of such structures can be found in the following U.S. patents: Liautaud U.S. Pat. No. 4,365,449 issued Dec. 22, 1982; Chertkof U.S. Pat. No. 2,198,450 issued Apr. 23, 1940; Mulvey U.S. Pat. No. 4,161,109 issued July 10, 1979; Smith U.S. Pat. No. 3,130,922 issued Apr. 28, 1964; Kruger U.S. Pat. No. 3,052,794 issued Sept. 4, 1962; and Guigli U.S. Pat. No. 3,064,851 issued Nov. 20, 1962.

Other prior art structures for light fixtures have been devised which combine artificial light and natural light sources for their illumination. Examples of such prior art structures can be found in U.S. patents such as Boyd U.S. Pat. No. 3,113,728 issued Dec. 10, 1963 and Dominguez U.S. Pat. No. 4,114,186 issued Sept. 12, 1978.

Many prior art natural light structures require that the structural members of the roof or ceiling be cut or modified to accommodate them. One natural light structure, shown in U.S. Pat. No. 4,339,900 issued July 20, 1982 to William Freeman, claims that no structural members need be modified for installation of the skylight dome unit shown therein. However, even in this prior art structure and every other structure that has attempted to utilize natural sunlight as an illuminating source for a light fixture mounted on the ceiling of a room, the weatherproofing and insulation is done at the roof line. These skylight type structures are exemplified by complexity and cost, thereby rendering them impractical and unusable by the ordinary homeowner.

A number of prior art roof membrane structures have been disclosed. A common feature of most of these structures, such as Wallenstein, U.S. Pat. No. 4,173,854; Mayerovitch, U.S. Pat. No. 4,194,498; Halsey et al., U.S. Pat. No. 4,520,604; and Cummings, U.S. Pat. No. 4,589,239 is the reliance on an elevated curb component to effect a water-tight construction. The elevation of the structure above the roof makes for an obtrusive and unsightly installation.

The present invention overcomes these disadvantages by providing a luminous ceiling fixture that utilizes natural and artificial light in combination which can be installed by a homeowner or builder without modifying structural members of the roof or ceiling and without extensive drywall modification. By using the skylight structure of the present invention, only the roof sheeting and membrane, such as the shakes or shingles of the roof, are removed on the exterior. Only drywall or plaster is removed from the interior ceiling. With the present skylight invention, there is no need for the expensive double-glazed roof skylight structure that is evident in the prior art. Single glazing is sufficient. Furthermore, the present invention provides for a substantially flush roof membrane structure such that the installation appears as unobtrusive as possible. The very labor-intensive light shaft construction required by the prior art ceiling lights is eliminated.

Because no structural roof members are cut, the present skylight structure may be used compatibly with truss roof construction. The skylight of the present invention produces excellent horizontal light under the ceiling, illuminating dark corners on the ceiling and easily accommodates fluorescent or incandescent light sources as an artificial backup for use at night.

SUMMARY OF THE INVENTION

A fixture framework for translucent light-diffusing panels is mounted over a hole in the ceiling of a room where a skylight is desired. The fixture framework is mounted so that it is sealed to the ceiling by a gasket material. Bolts fasten the fixture framework to the ceiling support beams or the ceiling itself. The light-diffusing panels are sealed to the fixture frame. The fixture may be hinged to permit opening for cleaning and replacement of light bulbs that may be mounted around the periphery of the ceiling hole. When closed, the hinged parts of the fixture are sealed to each other by a suitable gasket material. A lightweight translucent water-tight membrane in the roof need not be double-glaze insulated. A water-tight seal is effected in the plane of the roof, therefore no raised curb structure is required. The light entering at the roof membrane is channeled to the ceiling hole by a light tube constructed in-situ with a lightweight and flexible fabric lined with a light-reflecting coating. The roof membrane component is provided with an attachment groove to which the light-reflecting fabric can quickly and easily be affixed. The skylight fixture mounted over the hole in the ceiling is internally insulated to prevent air or moisture in the attic from entering the room or air from the room entering the attic.

BRIEF DESCRIPTION OF THE DRAWINGS

The objects and many of the attendant advantages of this invention will be readily appreciated as the same becomes better understood by reference to the following detailed description when considered in conjunction with the accompanying drawings, in which like reference numerals designate like parts throughout the figures thereof, and wherein:

FIG. 21 is a cross-section of the light tube fastening means of the roof membrane structure of FIG. 19 and FIG. 20;

FIG. 22 is a perspective view of a light tube fastening means; and

FIG. 23 is a perspective view of another light tube fastening means.

DESCRIPTION OF THE PREFERRED EMBODIMENT

Figure 1:
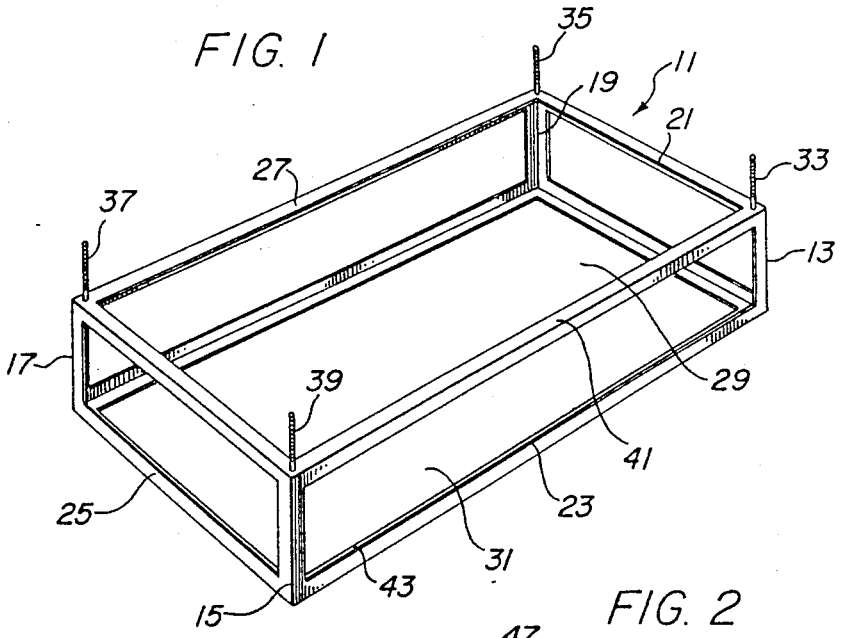
FIG. 1 is a perspective view of the fixture framework of the present invention.

Referring first to FIG. 1, a preferred framework construction 11 for the skylight fixture is illustrated. This framework construction fastens to the ceiling by way of a plurality of bolts 33, 35, 37 and 39 which are threaded and sufficiently long to pass through the ceiling support beams and thereby hold the framework 11 fast to the ceiling over an access hole cut into the ceiling.

The support bolts 33, 35, 37 and 39 are fastened to the ceiling bracket 41 of the light fixture framework 11. The ceiling bracket 41 is fastened to the bottom portion 13 of the light fixture frame 11 either structurally or by hinge and latch mechanisms, as will be explained hereinafter. The bottom portion 13 of the light fixture frame is preferably a rectangular unit with openings on its four sides 21, 23, 25 and 27, a large opening at the bottom 31, and an opening at the top where the ceiling bracket 41 also has a large opening 29.

The openings in the bottom portion 31 of the fixture frame are covered by translucent panels which are sized to fit the openings in the fixture frame. The fixture frame is constructed so that its four corners 13, 15, 17 and 19, for example, as well as all other corners and joints are sealed and airtight. Such sealing can be accomplished by use of sealing materials such as silicone sealant, urethane foam or similar material.

Figure 2:
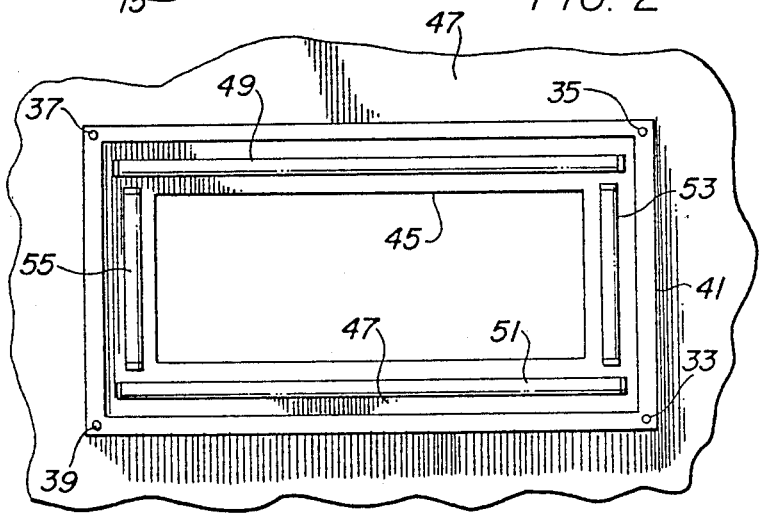
FIG. 2 is a top view looking at the ceiling with the bottom half of the fixture frame of the present invention removed.

The ceiling bracket 41 and its location with respect to the hole 45 in the ceiling through which natural light enters the fixture is illustrated in FIG. 2. As seen in FIG. 2, a hole 45 is located in a ceiling 47. The ceiling bracket 41 mounts to the ceiling 47 by way of the support bolts 33, 35, 37 and 39 which pass through the ceiling and through the 2×4 cross members mounted to the ceiling support beam. These cross members could, for example, span the ceiling joists above the bracket. The hole 45 is not quite as large as the support bracket 41, leaving sufficient rom 47 for incandescent or fluorescent light tubes 51, 53, 49 and 55 to be mounted around the perimeter of the hole 45.

Figure 3:
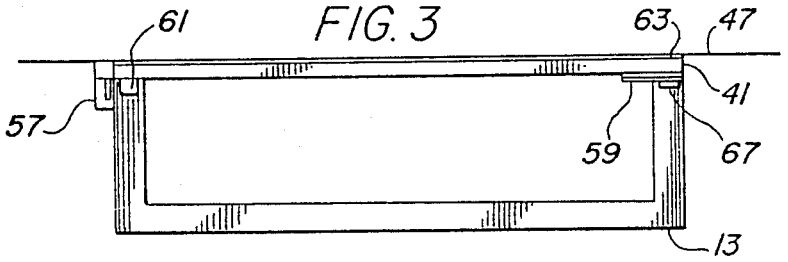
FIG. 3 is a side view of the fixture frame of the present invention.

Referring now to FIG. 3, the support bracket 41, when drawn up tightly against the ceiling 47, is sealed to the ceiling 47 by a foam rubber gasket 63 which is squeezed between the ceiling and the support bracket 41. The gasket 63 forms an airtight and water-impervious seal and prevents air moving between the attic area and the room at this juncture.

It is preferred that the bottom portion 13 of the light fixture 11 be hinged to the support bracket 41 which is rigidly mounted to the ceiling so that the fixture may be unlatched and cleaned and the fluorescent or incandescent light tubes replaced as they burn out. The juncture between the support bracket 41 and the bottom section 13 of the light fixture 11 is sealed by a gasket material 61 so as to prevent air from moving between the attic and the room through this juncture.

The hinge arrangement 59 is preferably located along a long side of the light fixture. A latch arrangement 57 is located along the opposite long side. The hinge and latch are chosen so as to provide a very tight and rigid fastening means between the mounting bracket 41 and the lower portion 13 of the light fixture 11.

Figure 4:
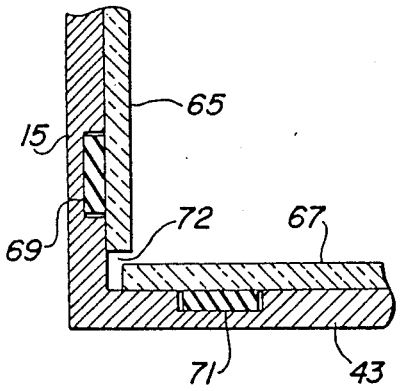
FIG. 4 is a sectional view of a corner of the fixture frame of the present invention with translucent panels located therein.

FIG. 4 illustrates how the translucent panels are sealed to the frame portion to cover the apertures in the lower part 13 of the light fixture frame 11. For purposes of illustration only, a corner of the lower portion 13 is illustrated showing the horizontal member 43 on which a translucent panel that covers the hole 31 (FIG. 1) of the light fixture frame rests and a vertical member 15 showing how a panel 65 covers the side hole 25 (FIG. 1) of the lower portion 13 of the light fixture frame.

The panels 65 and 67 may be SDP diffusing lenses or similar translucent panels. They are fastened and held in an insulated manner to the periphery of the frame construction by butyl tape 69 and 71. The tape is recessed in the frame sufficiently to allow the diffusing panels 65 and 67 to sit on the frame with no gaps therebetween. In addition, the corners 72 between the diffusing panel 65 on the vertical and the panel 67 on the horizontal may be sealed by urethane foam, suitable silicone sealing material or similar material. By insulating the fixture in this manner, no warm air in the room is lost through the light fixture to the hole in the ceiling and no cold air escapes into the warm room within which the light fixture is located.

Figure 5:
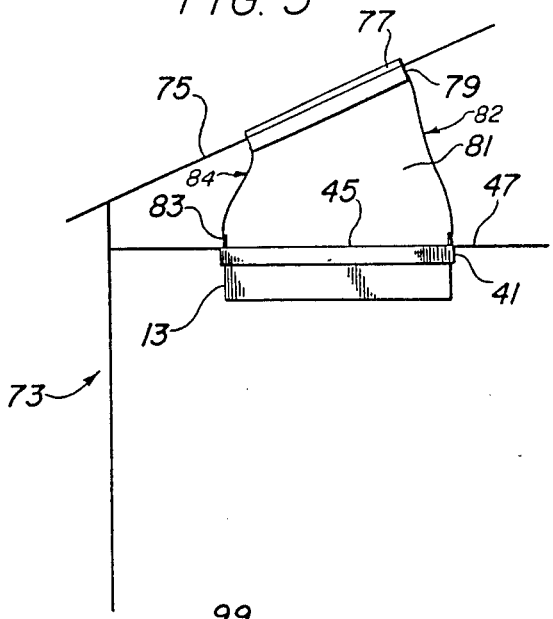
FIG. 5 is an illustration of all the elements of the light fixture structure according to the present invention showing their relationship with the roof and ceiling in an installation.

In order to provide for the transmission of light to the hole 45 in ceiling 47 over which the light fixture support bracket 41 is located and to which the lower portion 13 is fastened, a light tube 81 (FIG. 5) is utilized. As shown in FIG. 5, the conceptual association of a roof line with the ceiling 47 is illustrated. The roof line 75 is shown as having a membrane 77 which can be an inexpensive single-glazed structure that is simply waterproof and fracture-resistant. Such structures are well known to those of ordinary skill in this art. Such a membrane could, for example, actually be a part of a tile or shake roof. A company called Lite Tile and Shake Panels, Inc. manufactures and sells synthetic Spanish and shake roofing tiles. These synthetic roofing tiles could be manufactured to be translucent. These translucent tiles would serve the function of the roof membrane to admit light, while at the same time being a part of the roof covering.

Figure 6:
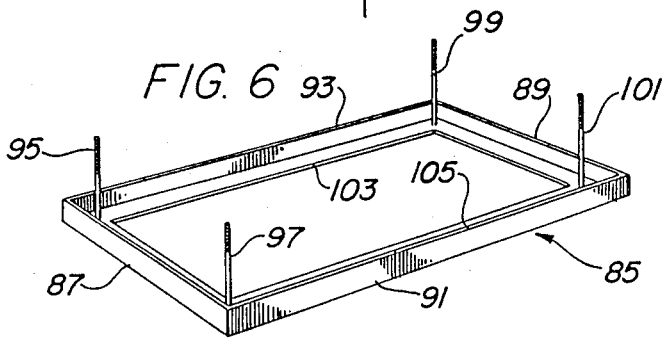
FIG. 6 is a perspective view of an alternate embodiment for a ceiling-mounted fixture according to the present invention.
Figure 7:
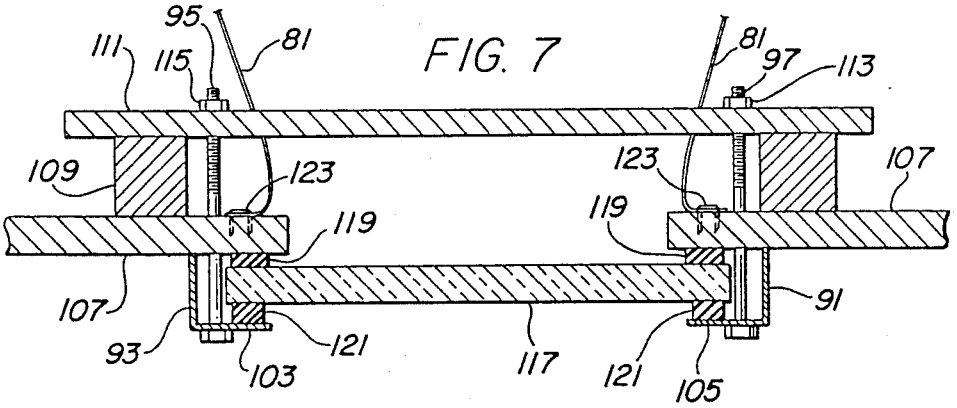
FIG. 7 is an end view in cross-section of the fixture of FIG. 6 with the translucent panel, mounting elements and sealing elements located therein.

Referring now to FIGS. 6 and 7, an alternate preferred embodiment for the skylight structure of the present invention is illustrated. This preferred embodiment is designed for low budget installations. FIG. 6 illustrates an aluminum frame 85 which is fabricated essentially out of four L-shaped pieces 89, 90, 87, 93 to form a rectangular framework. These pieces can be joined together by any convenient means such as welding or by sheet metal screws utilizing overlapping tabs (not shown). The upstanding or vertical portions of the frame members which are perpendicular to the ceiling are preferably one to one and one-half inches long, whereas the horizontal members such as 103 and 105 of the frame members may be two inches in width. The frame member 85 is held to the ceiling by a plurality of bolts 95, 97, 99, 101 which pass through the corners of the frame 85 through the ceiling into the ceiling support beam structure as more specifically shown in FIG. 7. The opening formed as a result of the four members of the ceiling frame 85 being joined together is overlaid by a translucent panel which may be light-diffusing if preferred, or clear, or of any other desired construction.

The manner in which the ceiling frame 85 is fastened to the ceiling and the manner in which a translucent panel 117 is located within the frame is more clearly shown in FIG. 7. FIG. 7 is essentially a cross-section of a finished and mounted skylight structure according to the present invention.

A rectangular aperture is cut into the ceiling 107. The frame 85 is mounted over this aperture. A translucent panel 117 is mounted within the frame 85 wedged between gasket material 121 that circumscribes the entire panel along its edge, and a water-impervious gasket 119 such as butyl tape, for example, which also circumscribes the perimeter of the translucent panels 117 on the other side of the panel in contact with the ceiling 107, thereby forming a water-impervious seal between the panel 117 and the ceiling. The gasket material 121 between the panel 117 and the horizontal legs 103, 105, for example, of the frame 85 forms an airtight seal. The bolts which hold the entire frame 85 to the ceiling such as bolts 95, 97 pass through the interior of the frame within the horizontal walls 93, 91, for example, through the ceiling 107 and through a hole in a cross-beam support member 111 which rests on the support ceiling joists 109 as located in any convenient position. The bolts 95, 96 squeeze the frame to the ceiling and thereby squeeze the translucent panel between the gaskets by way of nuts 113, 115, for example, being tightened down upon the support beam 111. The light tube fabric 81 may, for convenience, be fastened directly to the attic side of the ceiling by battens 123 or to a frame structure that may be constructed around the opening in the ceiling 107, which in turn is fastened to and supported by the ceiling joists 109.

The particular frame construction shown in FIGS. 6 and 7 does not provide for an artificial light source within the framework of the fixture. If an artificial light source is desired, the framework of FIG. 6 could be utilized to provide the natural source. Fluorescent fixtures would then be mounted around the frame of FIG. 6 in the manner shown in FIG. 2, and then the framework of FIG. 1 could be utilized to cover both the light fixtures and the frame 85. This construction again provides for the sealing out of air and moisture movement between the attic and room being irradiated by the natural light.

A light tube 81, preferably constructed of a nonporous, heavy metal-reflective plastic or nylon, is secured to the roof membrane 77 by a suitable fastening means. Examples of materials on the market that could be used for the light tube construction are a product of Duracote Corporation, sold under the trademark FOYLON, a product of Centrex Corporation which sells an entire line of aluminized fabrics. This light tube seals in the air within the tube, thereby keeping out dust and cold air from the attic area. The tube is sealed to the upper portion of the ceiling light fixture 83 in a similar manner. The tube is constructed in situ. Lengths of the fabric material are affixed to the transparent roof membrane structure and draped and routed towards the ceiling opening. Wood battens may be used to support and secure the material. The light tube may be fastened to the existing rafters and ceiling joists that lie in the common parallel directions. The size of the roof opening and the width of the fabric determines how many lengths of fabric must be used. The high reflectivity of this fabric allows great leeway in the light tube's construction. Neither a straight path nor an unobstructed passage nor a uniform cross-section is essential. After positioning of the fabric, the edges can be joined to complete the fabrication of the light tube. Such a construction can easily accommodate structural members or conduits passing therethrough. A pair of zippers 82 and 84 are provided in the light tube 81 as a convenient access for the purpose of cleaning the inside thereof when and if such cleaning becomes necessary.

The light tube functions to direct the light penetrating the roof membrane 77 towards the ceiling light fixture 11 and to the hole 45 in the ceiling, even though the hole 45 in the ceiling may not be directly below the roof membrane 77. Since the light tube 81 is covered internally with a layer of light-reflective material, it would tend to reflect the light in all directions and into the hole 45 in the ceiling; thereby providing a maximum of the light entering at the roof level membrane 77 to the light fixture 13. This provides considerable light at the fixture 11 even at lower sunlight intensities and cloudy days. At night, the same light fixture can function as a normal light fixture by utilizing the incandescent or fluorescent light sources mounted therein.

Figure 8:
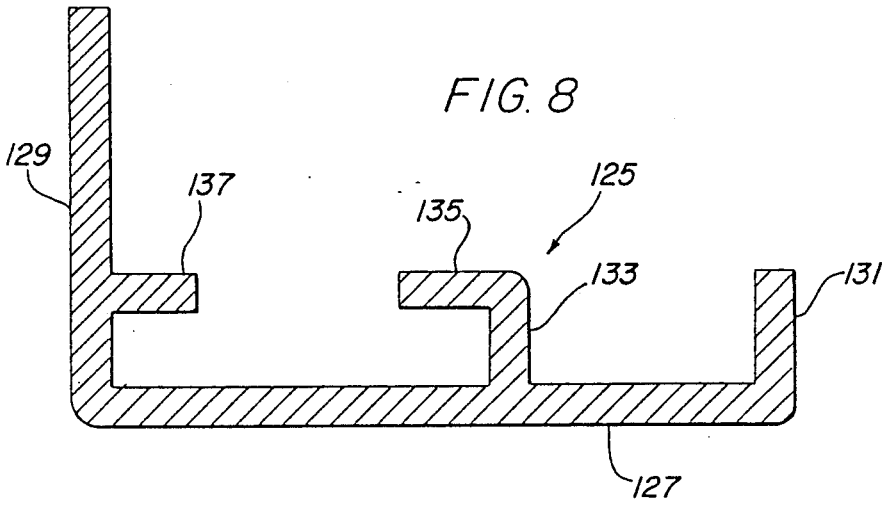
FIG. 8 is a sectional view of an alternate preferred embodiment for a frame structure according to the present invention.
Figure 9:
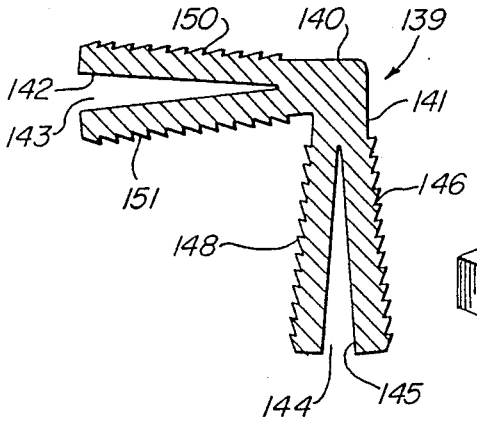
FIG. 9 is a plane view of a corner insert usable with the frame structure of FIG. 8.

Referring now to FIGS. 8, 9, 10 and 11, an alternate preferred embodiment for the frame construction usable in the present invention is illustrated. Referring first to FIG. 8, which shows the cross-section of the frame construction which is preferably made of extruded aluminum, frame member 125 is shown as essentially an L bracket with an upstanding leg 129 and a horizontal leg 127 which has compartments therein formed by protrusions from the upstanding horizontal legs. Two compartments are formed along the horizontal leg 127. An open compartment is formed by protrusion 133 and protrusion 131. This compartment is sized to accept the ceiling membrane which will contact the translucent panel in a manner to be explained below in connection with FIG. 11. The other compartment is formed by protrusions 133 and horizontal protrusions 135 and 137. This channel compartment has two functions. First, it is sized to accept a corner connector 139 (FIG. 9). Second, it accepts a bolt 147 (FIG. 10) for a purpose that will be explained in connection with FIG. 11.

The end connector 139 of FIG. 9 is utilized to connect four channel members of the type shown in FIG. 8 together to form a fixture frame much in the same manner that an extruded aluminum picture frame has its members connected together to form a picture frame. This provides considerable flexibility to the installer in sizing the frame for the installation, and allows the manufacturer to ship frame members 125 in standard lengths.

The corner connector 139 of FIG. 9 is uniquely constructed to provide a very tight and interlocking connection between two members of the frame. The corner connector basically comprises two legs 140 and 141 which are connected together at a 90° angle. The entire corner connector 139 may be made from a resilient plastic material or metal. Each leg is again divided into two fingers. Leg 140 has two fingers 142 and 143 which are separated in an angular manner. Leg 141 has a pair of fingers 144 and 145 which are likewise separated in an angular manner. The two fingers of either leg may be squeezed together to fit within the channel compartment shown in FIG. 8. Once inside the compartment, they will expand to grip the sidewalls thereof. To facilitate this gripping function, both fingers on each leg have a series of ripples thereon on their outside surfaces. Thus finger 142 has a series of ripples 150 on its gripping side, finger 143 has ripples 151, finger 144 has ripples 148, and finger 145 has ripples 146. These ripples, which are of the same material as the corner connector 139, help to grip the internal surfaces of the channel compartment of the frame of FIG. 8.

Figure 10:
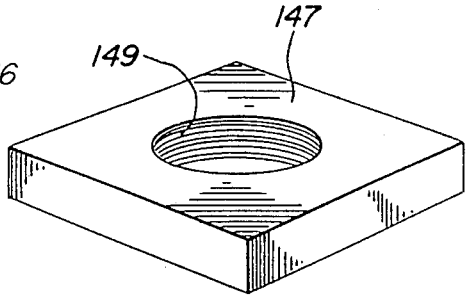
FIG. 10 is a perspective view of a nut usable with the frame structure of FIG. 8.
Figure 11:
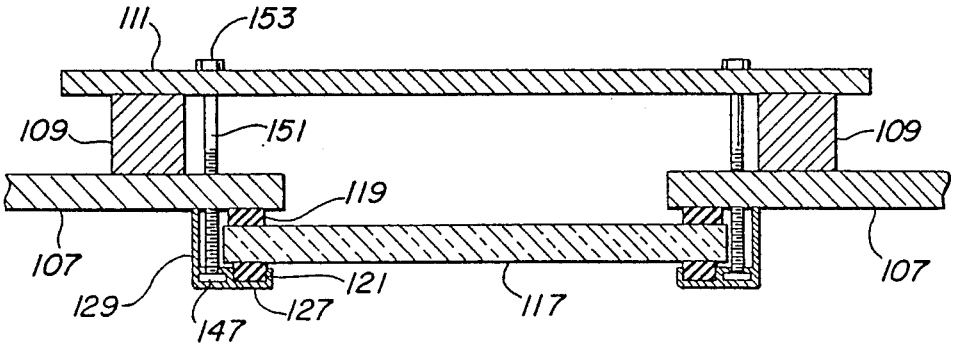
FIG. 11 is an end view in cross-section showing the fixture frame of FIG. 8 mounted to a ceiling.

Referring now to FIG. 11, all the elements of FIGS. 8, 9 and 10 cooperate with each other, and an actual installation is illustrated The ceiling 107 is cut to have an aperture therein, and the frame in its assembled form is installed so that vertical leg 129 is abutting against the ceiling 107 and the horizontal member 127 overlaps the translucent panel 117. In this manner, the aperture in the ceiling 107 is covered. Located between the translucent panel and the ceiling is a ceiling gasket such as butyl tape. Located between the translucent panel 117 and the horizontal leg 127 of the frame structure in the first compartment is another gasket material 121. The entire frame structure is held to the ceiling by way of a series of bolts 151, preferably four, one per each leg of the frame structure. A support beam 111 is placed over the ceiling beams 109. The bolt would pass through the support beam with the head being located in the attic side of the ceiling. The bolt threads into the threads 149 (FIG. 10) of nut 147 which is located in the second compartment of the frame structure.

Figure 12:
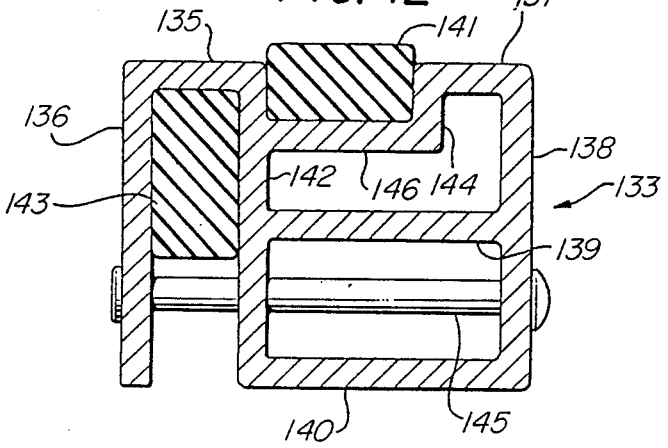
FIG. 12 is a sectional view of an alternate preferred embodiment for a frame structure according to the present invention.
Figure 13:
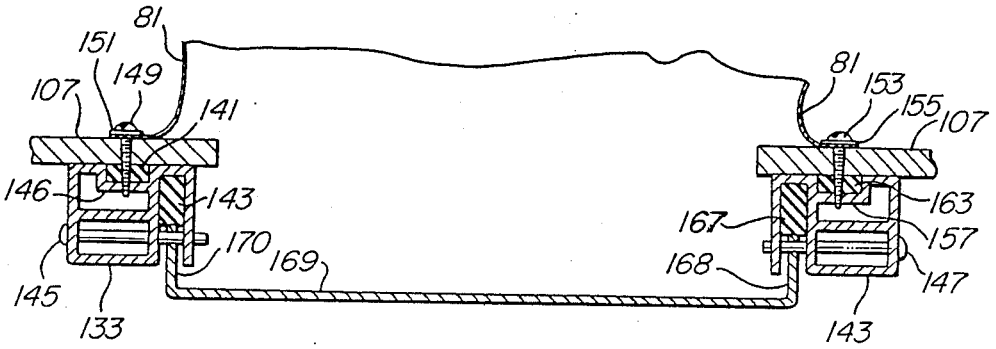
FIG. 13 is an end view in cross-section showing the fixture frame of FIG. 12 mounted to a ceiling.

Referring to FIGS. 12 and 13, another preferred embodiment for a frame construction is illustrated. FIG. 12 shows a cross-section of a leg of the frame structure 133 shown in cross-section with a rivet 145 utilized to fasten to a translucent covering (FIG. 13). The general frame member 133 may be constructed according to an extrusion process well known in the art for extruding aluminum. The member 133 is formed in convenient lengths in the cross-section shown in FIG. 12 so that the upper surface made up of lengths 135, 146 and 137 along the horizontal, as well as vertical sections 142 and 144 form a pocket therein within which is placed a water-impermeable gasket material 141 which contacts the ceiling, as illustrated in FIG. 13. The horizontal segment 135 and two vertical members 136 and 142 form another pocket within which is located a gasket material 143 that extends just above the rivet 145. This gasket material is utilized in a manner which will be explained below in connection with FIG. 13. An internal channel is formed in frame member 133 by the vertical segments 142, 144, 138 and the horizontal segments 146, 137 and 140. Within this internal channel is a horizontal support member 139 that runs the length of the frame member 133. There is nothing but air space located within this enclosure at various spots along its length which is into the paper (FIG. 12). Member 133 has holes located therein for receiving a rivet 145 as shown.

Referring now to FIG. 13, the frame member 133 is shown assembled into a frame structure and mounted to a ceiling 107 which has an aperture therein. The fixture frame is made up of four members. Two, members 133 and 134, being shown in cross-section, hold a translucent panel 169 thereby by way of rivets 145, 147 (other rivets not being shown). The fixture frame itself is held fast to the ceiling by a plurality of screws 149 and 153, for example, which screw down into members 146 and 157 of frame members 133, 134, respectively. As many screws as is necessary can be utilized to hold the frame members fast to the ceiling. However, no more than two per member is anticipated. Washer-type plates 151 and 155 may be utilized under the heads of the screws 149 and 153, respectively. These plates may also be utilized to hold down the ends of the light tube fabric 81.

Once the fixture frame itself is fastened to the ceiling, the translucent panel 169 which has vertical panels 170, 168 around its perimeter (only a cross-section being shown) is held fast to the fixture frame itself by way of the rivets 145 and 147. The vertical panels 170 and 168, for example, have holes therein which allow the rivets to pass through. The holes in the vertical panels 168 and 170 are located so that the distance between the holes in the end of the panel is greater than the distance between the end of the spongy gasket material 143, 167 and the center of the rivets 145 and 147 in the respective fixture members. Such being the case, to align the holes in the vertical members, vertical panels 168, 170 of the translucent panel 169 requires that the vertical members compress the gasket materials 143 and 167 to a certain degree. Inserting the rivets 145 and 147 through these aligned holes will thereby hold the translucent panel 169 fast to the fixture frame members.

Figure 14:
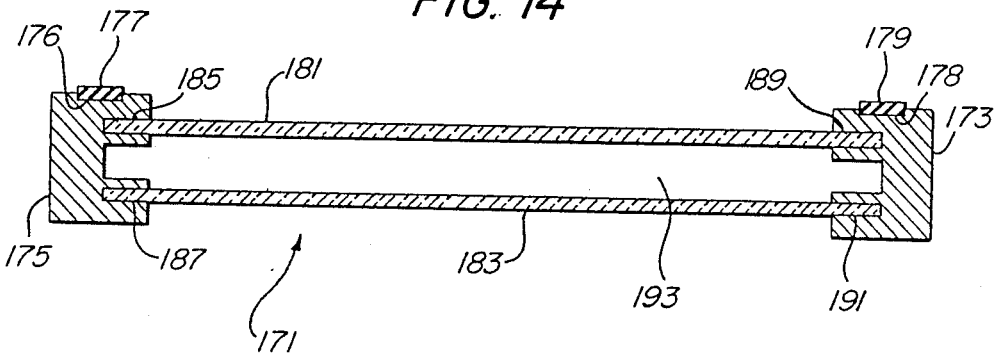
FIG. 14 is a sectional view of a translucent panel construction that could be used with the fixture frames disclosed.

An alternate preferred panel construction which is utilizable by the fixture frames that are designed for use of a straight panel such as the fixture frames shown in FIG. 11 and FIG. 7 is illustrated in FIG. 14. The translucent panel 171 is essentially a pair of panels 181, 183 held a certain distance apart so as to create an air space 193, by end pieces 173, 175. The panels 181, 183 are translucent, and may be clear or light-diffusing, as desired. The end pieces 173, 175 are preferably constructed out of a plastic material and have grooves therein to receive panels 181 and 183. It is preferred that these panels be glued with an appropriate epoxy-type glue in the areas 185, 187, 189, 191 and that the panels are recessed within the end pieces 173, 175 respectively.

The upper portion of the end pieces preferably contain a groove 176, 178 therein which contains a water-impervious gasket material 177, 179 therein for contacting the ceiling when installed in a fixture frame, such as shown in FIG. 11 and FIG. 7. This gasket material, for example, will be positioned in the manner of the gasket material 119 of FIGS. 7 and 11. This type of structure provides the additional advantage of containing the gasket material in a very defined area, thereby preventing it from being squeezed out or rolled out from under the surfaces it is meant to seal.

Figure 15:
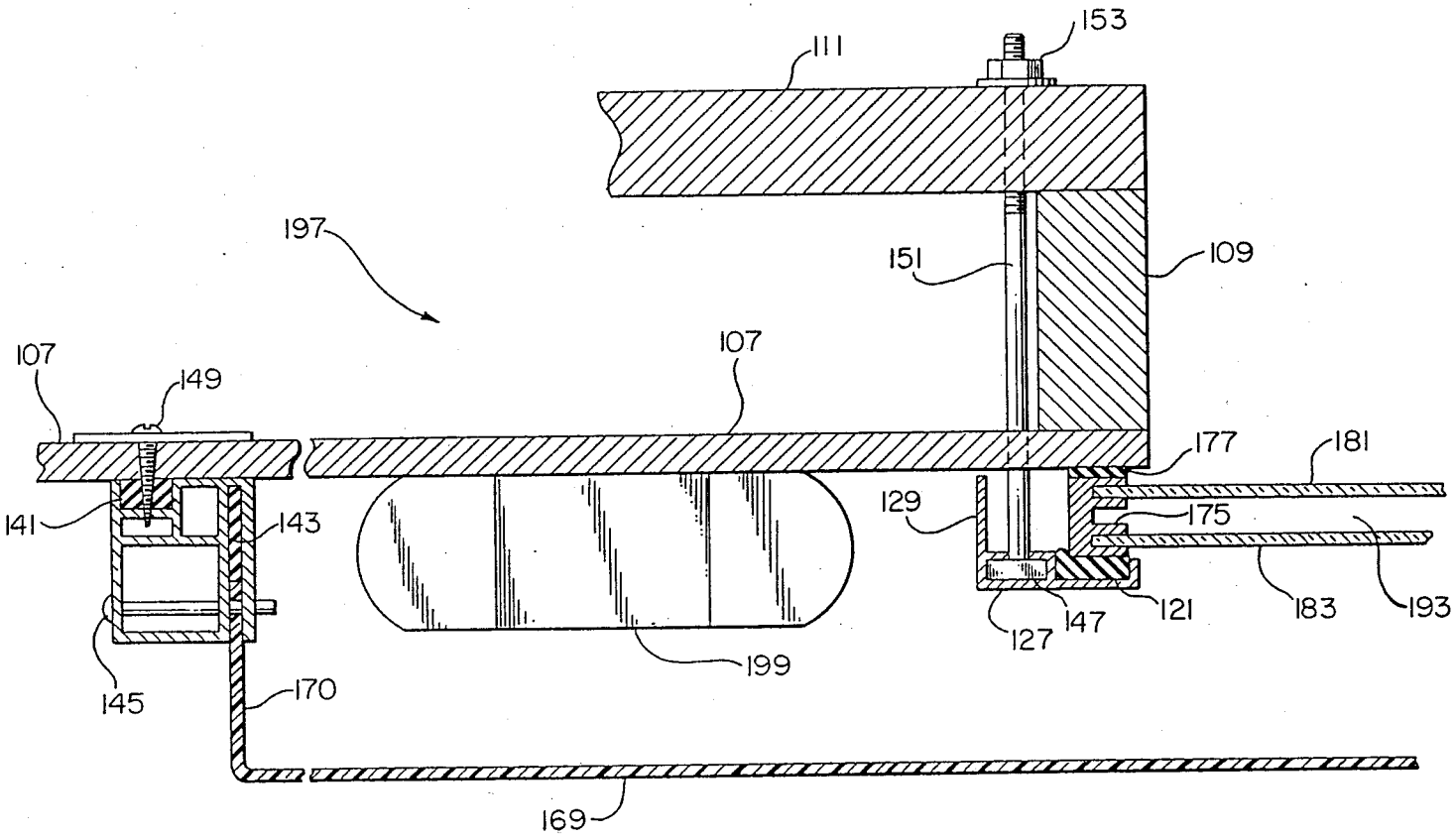
FIG. 15 is an end view in cross-section showing the use of the translucent panel construction of FIG. 14 together with the fixture frame of FIG. 13.

Referring now to FIG. 15, a skylight fixture 197 is illustrated which provides all the advantages of the present invention at an attractive price. The fixture assembly 197 provides both natural and artificial light as well as insulation at the ceiling 107. The artificial light is provided by incandescent or fluorescent fixture 144. Natural light is provided through the double pane translucent panel assembly 181, 183 which is an excellent insulator. The entire artificial and natural light assembly is covered by a translucent panel 169 for appearance purposes.

Figure 16:
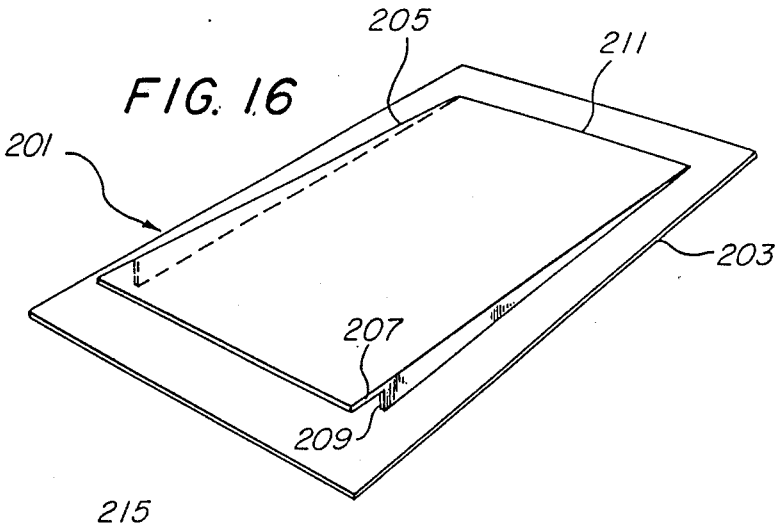
FIG. 16 is a perspective of a translucent roof panel construction according to the present invention.
Figure 17:
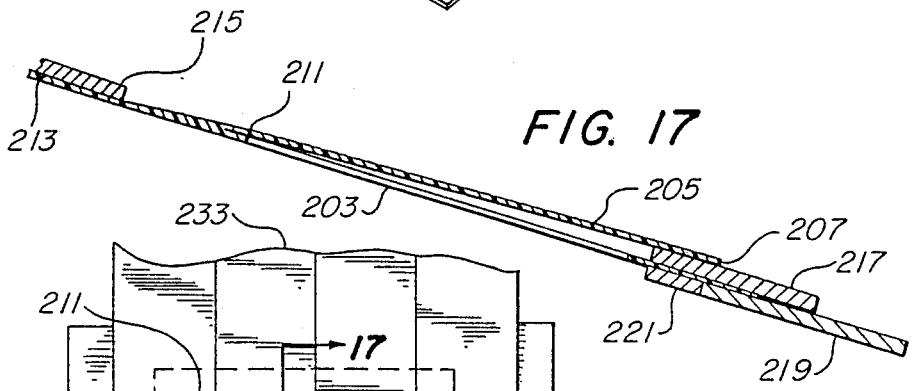
FIG. 17 is a side view in cross-section of the roof panel of FIG. 16 in place on a tile roof.
Figure 18:
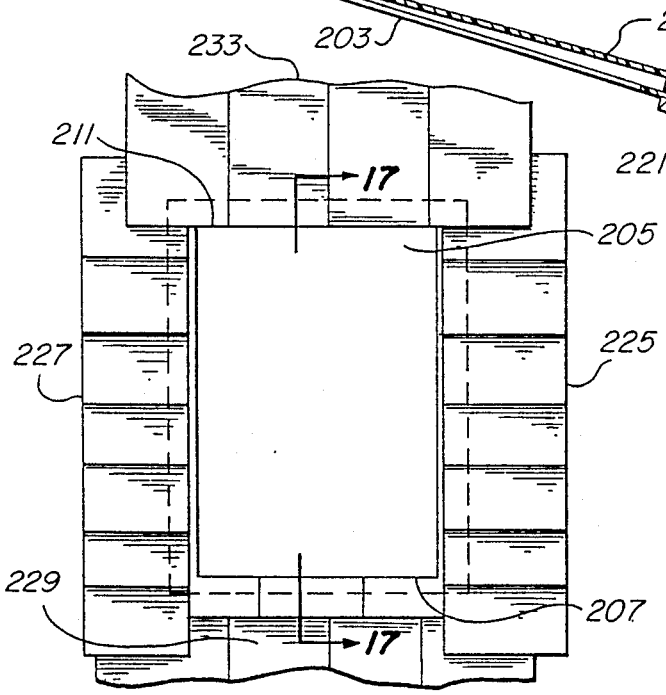
FIG. 18 is a top plan view of the roof panel of FIG. 16 in place on a tile roof.

Referring now to FIGS. 16, 17 and 18, a particularly simple and efficient roof membrane is illustrated. Referring first to FIG. 16, a perspective view of the roof membrane 201 constructed according to the present invention is illustrated. The roof membrane 201 is generally U-shaped, having a flat base 205 and a pair of side walls 201. The U-shaped channel has its side walls cut at an angle so that one end 211 has the side walls and bottom coming together. The wide end has a portion of its sides cut back a certain length 207 to provide an overhanging shelf 207. The entire U-shaped member is made out of a translucent material of the type that is used in fiberglass-reinforced panels such as LASCO-LITE as produced by Lasco Industries, a division of Phillips Industries, Inc. This U-shaped member is then attached through a well-known attachment material, such as gluing, to a flat panel 203 of the same material which is dimensionally larger than the U-shaped member. Besides providing a secondary sheet for the roof membrane, it provides a flashing edge, as will be explained hereinafter.

Referring now to FIG. 17, a side cross-section of the membrane of FIG. 16 installed on a shake or shingle roof is illustrated. The roof membrane 201 is mounted on the roof line 213 between a row of shingles or tiles, as illustrated. The row of shingles or tiles 215 holding down the flat secondary or flashing sheet at the tail end of 211 and row of tiles 217 overlying another row of tiles 219 and supporting or shim material 221. A row of tiles or shingles 217 fit snugly underneath the overhang 207. The flashing sheet 203 is attached to the row of tiles 25 and the row of tiles 219, 217 and support members 221 by mastic tape or other well-known caulking or waterproofing material.

The resultant installation would appear as shown in FIG. 18, wherein the back row of tiles 215 holds down the back end of the membrane 201 with the bottom face of the U-channel 205 facing the sky. The two rows of tiles 217 and 219 hold down the front end, the row 217 underlying the overhang 207 of the U-channel portion 205. Additional rows of tile along the side, like rows of tile 225 and 227, would overlie the flashing edges illustrated by the dashed lines of the secondary sheet 203 (FIG. 16). In installations in which a relatively large area is covered by the roof membrane, the installation of a support grid (not shown) disposed just below the membrane would provide the support required to keep a large expanse of membrane from drooping or sagging. Additionally, gridding of substantial diameter would prevent forced entry through the otherwise susceptible membrane structure.

Figure 19:
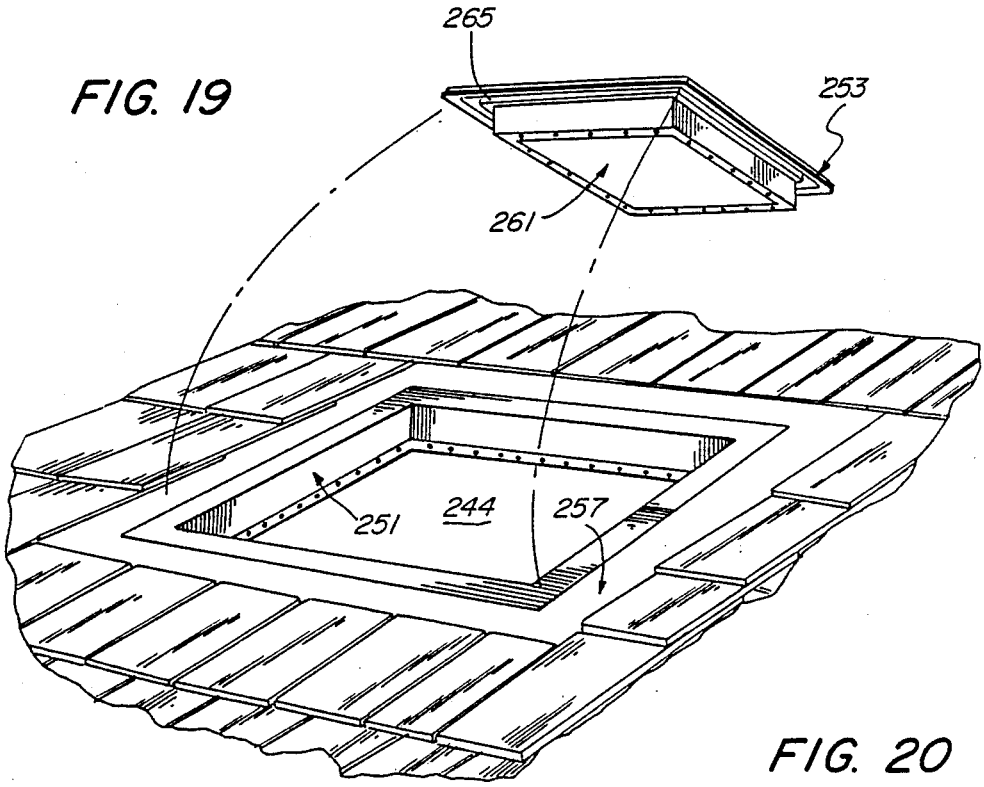
FIG. 19 is an exploded perspective view of a roof membrane structure.
Figure 20:
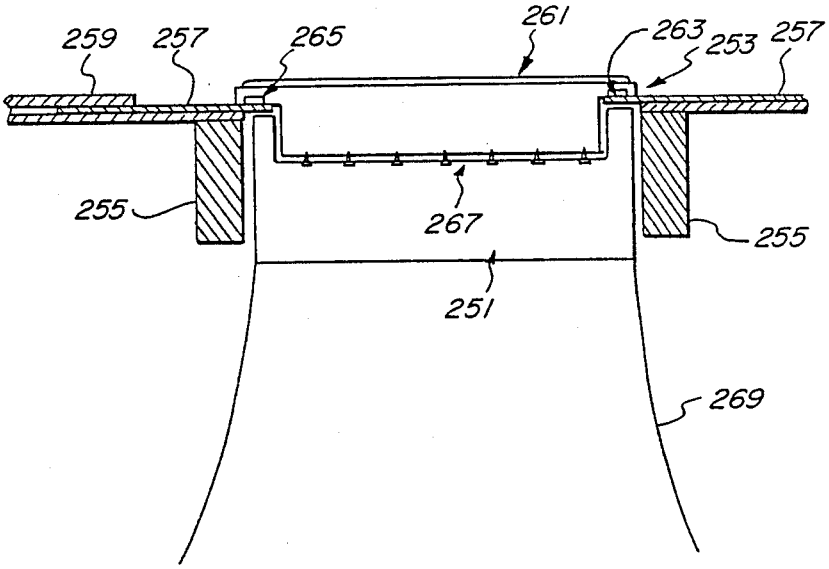
FIG. 20 is a side view in cross-section of the assembled roof membrane structure of FIG. 19.

Referring to FIGS. 19, 20 and 21, an alternate preferred roof membrane structure is illustrated. The structure essentially comprises two major components, a translucent member 253 that includes a framed transparent or translucent membrane 261, and a framework member 251 which is attached to the roof structure and to which both the translucent member and light tube 269 is attached. Gridding can be positioned just below the translucent member to provide support and prevent forced entry. A hole 249 is cut in the roof to conform to the size of the framework member 251 and the framework member is affixed to adjacent roof rafters 255 or header beams. Metal flashing 257 is installed to extend from under the existing water-tight roof membrane (e.g. roof paper and shingles 259) to the inner edge of the framework member. The translucent member has a groove around its periphery into which a sealing gasket 263, such as butyl rubber tape, is inserted. When the translucent member is subsequently tightened against the framework member via screws 267 or nuts and bolts, the gasket is compressed resulting in a water-tight seal. This type of configuration is especially well suited to an installation on an existing roof structure. In new construction where the flashing 257 need not be inserted under installed roofing material 259, an alternative skylight structure can be used wherein the flashing is part of frame 265. This obviates the need for the sealing gasket 263. After installation of the skylight, the required roofing material can be applied over the flashing portion of the skylight.

The bottom edge of the framework member is split or grooved. The light-reflecting fabric 273 used to fashion the light tube is draped over a dowel 275 or other complementing member which is subsequently forced into the groove. Such fastening system provides a quick and simple means of attaching the light tube.

An alternative fastening system is shown in FIG. 22. Lengths of an extrusion 281 are fastened 282 around the perimeter of the skylight, to vertical members between roof and ceiling and around the perimeter of the ceiling opening. Fasteners 282 can comprise nails or screws or other suitable means. The extrusion 281 has a longitudinal protuberance 283 that retains spring clips 285 when forced thereon. The reflective fabric for the light shaft is simply draped over the protuberance after which the clips are forced on at appropriate intervals. The extrusion can be adapted to clip on to specialized ceiling structures which would further simplify installation. For instance, the T-bars 289 used for suspending ceilings in dropped-ceiling type structures can be used to anchor the reflective fabric by adapting an extrusion 281 to clip or be crimped on to the vertical section of the T-bar. The extrusion may, for example, have a narrow barbed channel 287 which can be simply forced on to the T-bar. The light-reflective fabric is subsequently draped over the protuberance 283 and the clips 285 are snapped on over the fabric. This simple and quick fastening means results in a permanent installation.

What has been described is a skylight fixture construction that may be used with truss roofs which produces good horizontal light to the ceiling and may include fluorescent or incandescent artificial light backup. It provides for sealing out outside air at the room ceiling level rather than at the roof level, thereby making it easy to install and maintain inexpensively, as well as providing complete privacy for interior occupants.

It should be understood, of course, that the foregoing disclosure relates only to a preferred embodiment of the invention, and that numerous modifications may be made therein without departing from the spirit and scope of the invention as set forth in the appended claims.

What is claimed is:

1. An energy efficient skylight structure for conducting light from the exterior to the interior of a building having a roof and ceiling comprising:

a framed light-diffusing panel;

means for attaching the framed light-diffusing panel over an opening in the ceiling from below;

sealing means between the framed light-diffusing panel and the ceiling;

a roof membrane of light translucent materials;

a light-channeling means attached at one end around the light translucent roof membrane and at the other end around the opening in the ceiling, said light-channeling means comprising a light tube being formed of a cloth-like fabric coated at least on one side with light-reflective material; and attachment means for attaching said light channeling means comprising:

an extrusion having a longitudinal protuberance thereon;

a plurality of spring clips fastenable about said protuberance;

whereby the extrusion is affixed to any available surface near desired path of the light tube, the fabric is passed over the protuberance and the clips are fastened thereon to hold the fabric in place.

2. The skylight structure of claim 1 wherein the sealing means comprises a butyl tape.

3. The skylight structure of claim 1 wherein the extrusion has a notched groove capable of receiving T-bar members of dropped-ceiling suspensions.

4. The skylight structure of claim 1 wherein the framed light-diffusing panel comprises:

a framework fabricated from four "L"-shaped members, the vertical portions of said "L"-shaped members being in proximity to the ceiling when the fixture is in place;

a plurality of bolts running through said framework at its corners to fasten the fixture to the ceiling;

a light panel sized to fit the opening in said framework overlaying the horizontal portion of the "L"-shaped members in said framework;

a first gasket material located between said light panel and the horizontal members of said frame for sealing said panel to said horizontal members of the frame;

a moisture-impervious second gasket material located between said light panel and the ceiling around the perimeter of the panel for sealing said panel to the ceiling; and said light panel, said first and said second gasket material forming a sandwich at the perimeter of said light panel that is sufficiently thicker than the width of said vertical portion of the "L"-shaped members to permit sealing between the surfaces thereof when the fixture is drawn tight to the ceiling by the said bolts.

5. The skylight structure of claim 4 wherein said framework is fabricated from extruded aluminum "L"-shaped members.

6. The skylight structure of claim 5 wherein said light panel comprises a panel that is translucent and light-diffusing.

7. The skylight structure of claim 6 wherein said first gasket material comprises a moisture-impervious gasket.

8. The skylight structure of claim 7 wherein said second gasket material comprises a butyl tape.

9. The skylight structure of claim 7 wherein said second gasket material comprises an air and moisture-impervious neoprene gasket.

10. An energy-efficient skylight structure for conducting light from the exterior to the interior of a building having a roof and ceiling comprising:

a framed light-diffusing panel;

means for attaching the framed light-diffusing panel near an opening in the ceiling from below;

sealing means between the framed light-diffusing panel and the ceiling;

a roof membrane, including a translucent sheeting material;

a frame, surrounding said sheeting material, having a groove along its bottom surface for receiving gasket material;

a gasket material inserted in said groove;

a framework member attachable to the roof support members located in proximity to an opening cut in the roof, said framework member being positioned so that its top edges are flush with the surface of the roof; and means for drawing said frame tightly to said framework member so as to compress the gasket material and effect a water-tight seal in between said frame and the top edges of the framework; and a light-channeling means attached at one end around the light translucent roof membrane and at the other end around the opening in the ceiling, said light-channeling means comprising a light tube being formed of a cloth-like fabric coated at least on one side with light-reflective material.

11. The roof membrane of claim 10, wherein the framework member has a groove along its bottom edges for receiving a dowel wrapped with one edge of a length of light-reflective fabric material.

12. The roof membrane of claim 10 wherein flashing material is sandwiched in between said frame and said framework structure and extending out along the surface of the roof.

13. The roof membrane of claim 10 wherein the gasket material comprises butyl rubber tape.

* * * * *